US005940044A

United States Patent [19]

Smith

[11] Patent Number: 5,940,044

[45] Date of Patent: Aug. 17, 1999

[54] 45 DEGREE POLARIZATION DIVERSITY ANTENNAS

[75] Inventor: Richard L. Smith, Dallas, Tex.

[73] Assignee: Allen Telecom Inc., Solon, Ohio

[21] Appl. No.: 09/010,737

[22] Filed: Jan. 22, 1998

[51] Int. Cl.[6] ..... H01Q 21/00

[52] U.S. Cl. ..... 343/810; 343/794; 343/893

[58] Field of Search ..... 343/727, 793, 343/794, 817, 893, 872, 810

[56] References Cited

U.S. PATENT DOCUMENTS 5,629,713 5/1997 Mailandt et al. ..... 343/808

*Primary Examiner*—Don Wong
*Assistant Examiner*—Tan Ho
*Attorney, Agent, or Firm*—Laff, Whitesel & Saret, Ltd.

[57] ABSTRACT

A 45 degree polarization diversity antenna having improved beamwidth characteristics. The antenna includes a plurality of dipole sub-arrays each sub-array comprising four dipole elements arranged in a diamond shape. Two dipole elements in each sub-array are arranged at an angle of approximately plus 45 degrees from the earth's surface to form a plus 45 degree polarized dipole element array and the other two dipole elements are arranged at an angle of minus 45 degrees from the earth's surface to form a minus 45 degree polarized dipole element array. The dipole elements are arranged such that the phase centers of one plus 45 degree dipole element and one minus 45 degree element line up along a first substantially vertical line and the phase centers of the remaining plus 45 degree and minus 45 degree dipole element line up along a second substantially vertical line.

24 Claims, 2 Drawing Sheets

45 DEGREE POLARIZATION DIVERSITY ANTENNAS

FIELD OF THE INVENTION

The present invention relates to polarization diversity antennas. More particularly, the present invention relates to 45 degree polarization diversity antennas having improved isolation characteristics.

BACKGROUND OF THE INVENTION

Antennas designed for operation in cellular radiotelephone systems and personal communication systems (PCS) are often configured to serve only a single sector of a cell. Such antennas are often implemented as panel antennas because control of horizontal beamwidth is more easily implemented in a panel configuration, thus making the panel antenna nearly ideal for sectorized cell sites.

Because cell sites in both cellular and PCS applications serve primarily mobile and portable subscribers, relative motion between the cell site and the subscriber units must be taken into account. In urban environments, there may also be regions within each cell site where coverage is difficult because of tall buildings or other obstructions. Such obstructions can give rise to multipath transmissions and result in interference.

One way to address such coverage difficulties is to provide diversity reception. Diversity refers to the concept of providing more than one antenna for communication between the cell site and subscribers. Usually, diversity is provided for the receive path only, although transmit diversity can also be useful in addressing certain propagation problems. Diversity is also generally provided at the cell site only, but many mobile subscribers implement diversity reception via the provision of multiple vehicle antennas.

Polarization diversity can be brought into play to address communication difficulties. Polarization refers to the orientation of the electric field (E-field) of a transverse electromagnetic (TEM) wave with respect to the earth's surface. A half-wave dipole oriented perpendicular to the earth's surface will exhibit vertical polarization, and the same dipole antenna rotated so that it is parallel to the surface of the earth is said to be horizontally polarized.

Antenna systems that include vertically and horizontally polarized arrays are known for cellular and PCS communication systems. Often, the vertically polarized array is used for transmitting, with diversity switching provided between the vertical and horizontal arrays to provide polarization diversity for the receive path. However, this configuration does not provide optimum coverage for some types of communication units.

Subscribers using portable communication units are usually careless regarding the orientation of the antenna during a conversation. Those who are used to communicating over portable two-way radios, such as police, fire protection personnel, etc., will often consciously attempt to maintain a vertical antenna orientation during radio communication. This is not true for members of the general public, however, who use portable cellular and PCS units just as though they were landline telephone sets, and are often unaware that radio communication is occurring as a consequence of the telephone calls they place and receive with their cellular and PCS "phones."

These users often have the antenna oriented at a 45 degree angle with respect to the earth's surface. This is something of a "natural" angle considering the design of modern portable units. With the unit held to the ear in normal conversation position, the antenna tends to be oriented at about 45 degrees with respect to the horizontal.

Polarization diversity with antennas oriented at plus and minus 45 degrees are very effective for communicating with a subscriber population consisting largely of portable units. Conventional 45 degree polarization antennas comprise two dipole element arrays one at plus 45 degrees and one at minus 45 degrees from the earth's surface. The dipole element arrays are arranged as dipole pairs, with each dipole pair consisting of a plus 45 degree dipole element from one array and a minus 45 degree dipole element from the other array which intersect at their midpoints.

These types of antenna provide suitable 45 degree polarization, however the radiation pattern beamwidth is poor, typically around 90°. The beamwidth size effects the gain of the antenna. A radiation pattern having a smaller beamwidth is projected farther forward along the horizontal plane and less along the vertical plane. Thus, the smaller the beamwidth, the larger the antenna gain.

Prior attempts to reduce the beamwidth size of an antenna system typically compromise the isolation between antenna elements in order to decrease beamwidth size. However, proper isolation is an important element of polarization diversity antenna systems. Accordingly, a need arises for a 45 degree polarization diversity antenna system which has a reduced radiation pattern beamwidth and which does not compromise the isolation between the dipole elements comprising the antenna system.

SUMMARY OF THE INVENTION

In accordance with the present invention, a 45 degree polarization diversity antenna comprises a plurality of dipole sub-arrays including first, second, third, and fourth elongated dipole elements secured to a back plate, each dipole element having a phase center. Each first and third dipole element is arranged at an angle of approximately plus 45 degrees from the earth's surface and each second and fourth dipole element is arranged at an angle of approximately minus 45 degrees from the earth's surface.

Preferably, the first, second, third and fourth dipole elements are positioned in a non-intersecting manner. In each dipole sub-array, the phase centers of the first and second dipole elements are positioned along a first substantially vertical line, the phase centers of the third and fourth dipole elements are positioned along a second substantially vertical line, the phase centers of the first and fourth dipole elements are positioned along a first substantially horizontal line and the phase centers of the second and third dipole elements are positioned along a second substantially horizontal line. In this manner, the first, second, third and fourth dipole elements in each dipole sub-array are arranged in a diamond shape with each dipole element orthogonal to the two dipole elements closest to it.

The first substantially vertical lines for all sub-arrays are arranged along a first overall substantially vertical line such that the phase centers for all first and second dipole elements in the antenna line up vertically along the first overall substantially vertical line. The second substantially vertical lines for all sub-arrays are arranged along a second overall substantially vertical line such that the phase centers for all third and fourth dipole elements in the antenna line up vertically along the second overall substantially vertical line.

All first and third dipole elements in the antenna combine to form a first dipole element array and all second and fourth dipole elements in the antenna combine to form a second dipole element array. The dipole elements in the first dipole element array are fed with a first set of feed lines and the dipole elements in the second dipole element array are fed with a second set of feed lines. Preferably, the dipole elements are fed in phase and in parallel.

The antenna further comprise isolation plates between each dipole sub-array for enhancing the isolation between the dipole elements of the antenna. Preferably, the horizontal beamwidth of the antenna is approximately 60 degrees. The antenna also includes a radome secured to the back plate for protecting the dipole elements and the back plate.

Further objects, features and advantages of the present invention will become apparent from the following description and drawings.

DETAILED DESCRIPTION OF THE INVENTION

Figure 1:
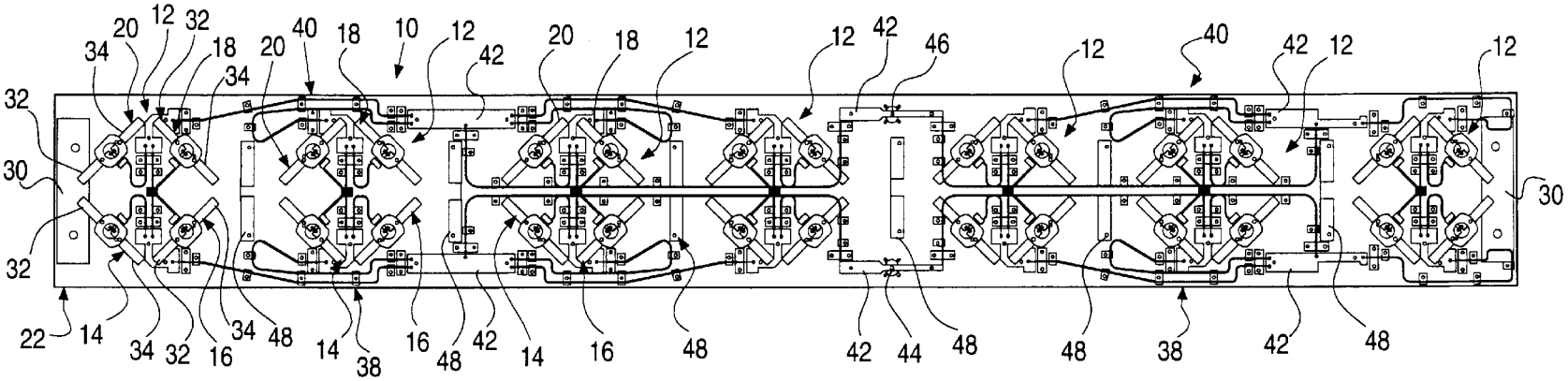
FIG. 1 is a top plan view of a 45 degree diversity polarization antenna according to the present invention.
Figure 2:
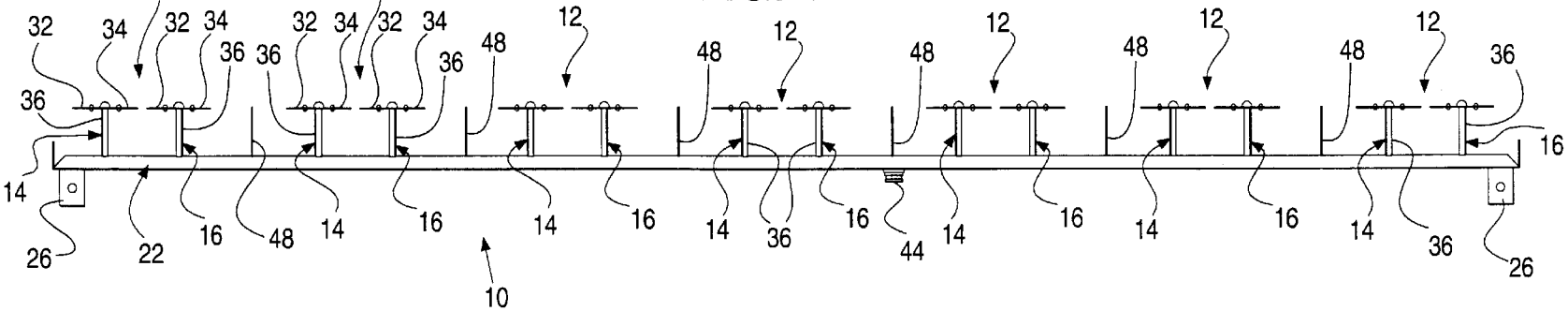
FIG. 2 is a side view of the antenna of FIG. 1.
Figure 3:
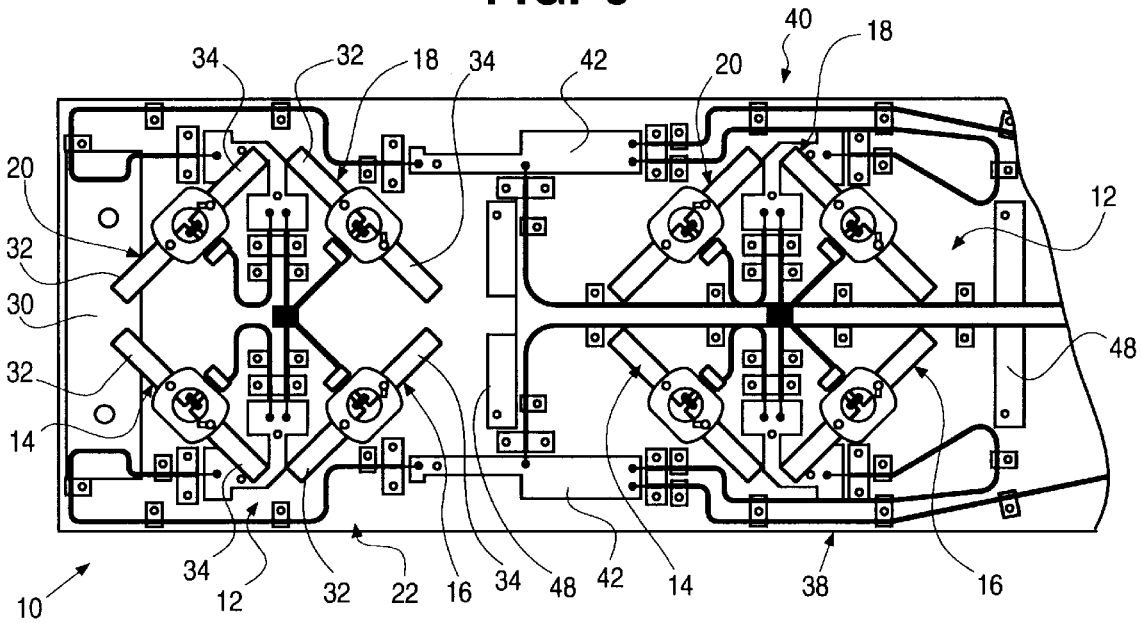
FIG. 3 is a partial enlarged view of the dipole element arrangement of the antenna of FIG. 1.
Figure 4:
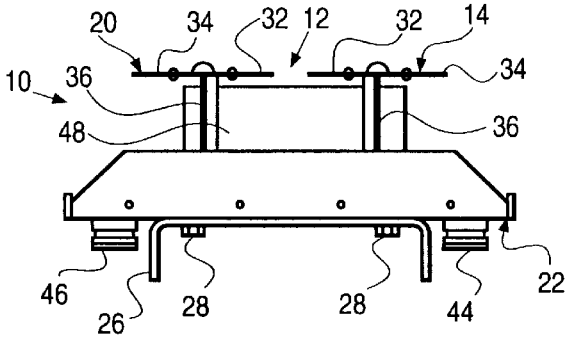
FIG. 4 is an end view of the antenna of FIG. 1.
Figure 6:
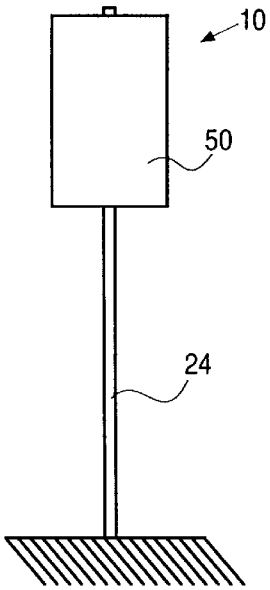
FIG. 6 is a schematic view of the antenna of FIG. 5 mounted on a mounting structure.
Figure 5:
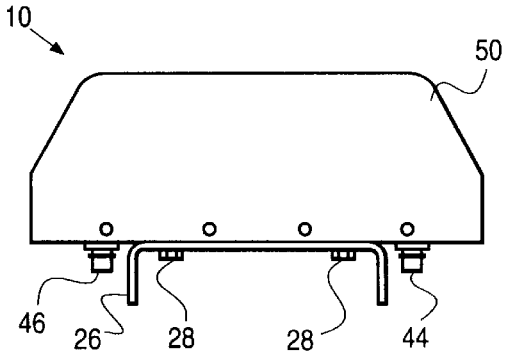
FIG. 5 is an end view of the antenna of FIG. 1 with a radome secured to the back plate of the antenna.

In accordance with the present invention, a 45 degree polarization diversity antenna is described that provides distinct advantages when compared to those of the prior art. The invention can best be understood with reference to the accompanying drawing figures.

Referring now to the drawings, an antenna according to the present invention is generally designated by reference numeral 10. The antenna system 10 comprises a plurality of dipole sub-arrays 12, each sub-array 12 including a first, second, third and fourth dipole element, 14, 16, 18, and 20, respectively. The dipole elements 14, 16, 18, and 20 are secured to an antenna system back plate 22. The back plate 22 is configured to block radiation emitted from the dipole elements 14, 16, 18, and 20 toward the back plate 22 as well as provide structural support for the antenna system 10. Preferably, the back plate 22 comprises an elongated conductive material that has good structural properties but is relatively light in weight, such as aluminum. In a preferred embodiment, the back plate 22 is of an aluminum sheet metal construction. Alternatively, the back plate 22 may be an aluminum extrusion.

The antenna system 10 is typically secured to a mounting structure 24, such as a pole, building or antenna tower. In a preferred embodiment, mounting brackets 26 are attached to the side of the back plate 22 opposite the dipole elements 14, 16, 18, and 20 by a pair of suitable fasteners 28. Braces 30 can further be included on the dipole element side of the back plate 22 for providing additional structural support for the mounting brackets 26. The mounting brackets 26 are used to secure the back plate 22 and thus the antenna system 10 to the mounting structure 24. Antenna system 10 is configured to be mounted with the length of the back plate 22 extending generally vertically to the earth's surface.

The first and third dipole elements 14 and 18 are tilted 45 degrees to the right of vertical. The second and fourth dipole elements 16 and 20 are tilted 45 degrees to the left of vertical. This arrangement causes the first and third dipole elements 14 and 18 to be at an angle of approximately plus 45 degrees from the earth's surface and the second and fourth dipole elements 16 and 20 to be at an angle of approximately minus 45 degrees from the earth's surface when the antenna system 10 is mounted to the mounting structure 24. In this manner, all first and third dipole elements 14 and 18 of the antenna system 10 combine to form a first dipole element array with a plus 45 degree polarization and all second and fourth dipole elements 16 and 20 of the antenna system 10 combine to form a second dipole element array with a minus 45 degree polarization.

Preferably, the dipole elements 14, 16, 18, and 20 of each dipole array 12 are positioned in a diamond shape such that each individual dipole element is orthogonal to the projected lengths of the two closest dipole elements and none of the dipole elements 14, 16, 18, and 20 are intersecting. In this arrangement, the phase centers of the first and second dipole elements 14 and 16 are positioned along a first substantially vertical line and the phase centers of the third and fourth dipole elements 18 and 20 are positioned along a second substantially vertical line which is separated from the first substantially vertical line. Also, the phase centers of the first and fourth dipole elements 14 and 20 are positioned along a first substantially horizontal line and the phase centers of the second and third dipole elements 16 and 18 are positioned along a second substantially horizontal line. Thus, the first dipole element 14 is orthogonal to the second dipole element 16 and the fourth dipole element 20, the second dipole element 16 is orthogonal to the first dipole element 14 and the third dipole element 18, the third dipole element 18 is orthogonal to the second dipole element 16 and the fourth dipole element 20, and the fourth dipole element 20 is orthogonal to the first dipole element 14 and the third dipole element 18.

The first substantially vertical lines for all dipole sub-arrays 12 lie along a first overall substantially vertical line and are therefore generally coincident, and the second substantially vertical lines for all dipole sub-arrays 12 lie along a second overall substantially vertical line and are generally coincident. In this manner, the phase centers for all first and second dipole elements 14 and 16 in the antenna system 10 line up vertically along the first overall substantially vertical line and the phase centers for all third and fourth dipole elements 18 and 20 in the antenna system 10 line up vertically along the second overall substantially vertical line.

The dipole elements 14, 16, 18, and 20 are conventional in design and comprise two dipole halves 32 and 34 secured to the back plate 22 by a so-called symmetrizer or balancer. Typical balancers comprise retention rods 36 which carry the dipole halves 32 and 34 and extend toward the back plate 22. The retention rods 36 are secured to the back plate 22 and dipole halves 32 and 34 by suitable fasteners.

Each dipole element 14, 16, 18, and 20 is fed by conventional feed circuitry. The feed circuitry comprises separate sets of feed lines 38 and 40 for each dipole element array. Preferably, the dipole elements 14, 16, 18, and 20 of each array are fed in parallel and in phase such that the phase center of each dipole element 14, 16, 18, and 20 is located at the physical center of the dipole element.

The feed lines 38 and 40 comprise shielded electrical cables. One end of the center conductor of each feed line 38 and 40 is electrically connected to a corresponding dipole element 14, 16, 18, and 20 such as by soldering or brazing.

The opposite end of each center conductor is electrically connected to a power divider or circuit board transformer 42, as by soldering or brazing. The lengths of the feed lines 38 and 40 are selected to provide the proper phase relationship between the dipole elements 14, 16, 18, and 20.

In a preferred embodiment, the transformers 42 comprise brass sheets cut into precise shapes. The brass sheets are secured to the back plate 22 by plastic fasteners with plastic spacers placed between the brass sheets and the back plate 22 to hold the brass sheets away from the back plate 22. Alternatively, the transformers 42 may comprise a glass fiber board element, with a pair of generally U-shaped traces which merge to form an M-shaped trace pattern of microstrip transmission line.

The transformers 42 act to divide input power equally between the dipole elements, while maintaining a proper impedance match. Thus, each dipole element 14, 16, 18, and 20 is connected to a source of RF (radio frequency) power via the sets of feed lines 38 and 40 and transformers 42.

Each series of feed lines 38 and 40 is connected to a transmission line (not shown) via a connector 44 and 46 respectively. The transmission lines connect the antenna system 10 to a base station (not shown).

In its preferred embodiment, the antenna system 10 has a horizontal beamwidth of about 60 degrees. In order to improve isolation between dipole elements 14, 16, 18, and 20 in the various dipole sub-arrays 12, isolation plates 48 of conductive material are disposed between each dipole sub-array 12. These isolation plates 48 are connected to the back plate 22 by suitable fasteners and extend across the back plate 22 past the first and second substantially vertical lines along which the dipole element phase centers lie. These isolation plates 48 act to eliminate cross-talk between dipole sub-arrays 12 and cut off long standing waves which tend to develop along the length of the back plate 22.

Preferably, a protective housing, such as a radome 50, is secured to the back plate 22 for covering and protecting the back plate 22 and the dipole elements 14, 16, 18, and 20. The radome 50 comprises a plastic housing which is generally U-shaped in cross-section and which envelopes the dipole elements 14, 16, 18, and 20 and other electrical elements of the antenna system to protect them from the environment.

It will be apparent to those skilled in the art that modifications may be made without departing from the spirit and scope of the invention. Accordingly, it is not intended that the invention be limited except as may be necessary in view of the appended claims.

What is claimed is:

1. A 45 degree polarization diversity antenna comprising:

a plurality of dipole sub-arrays, each dipole sub-array including:

first, second, third, and fourth elongated dipole elements each having a phase center, said first and third dipole elements being arranged at an angle of approximately plus 45 degrees from the earth's surface and said second and fourth dipole elements being arranged at an angle of approximately minus 45 degrees from the earth's surface;

said first, second, third, and fourth dipole elements being positioned in a non-intersecting manner and wherein the phase centers of the first and second dipole elements are positioned along a first substantially vertical line and the phase centers of the third and fourth dipole elements are positioned along a second substantially vertical line and the phase centers of the first and fourth dipole elements are positioned along a first substantially horizontal line and the phase centers of the second and third dipole elements are positioned along a second substantially horizontal line such that said first, second, third, and fourth dipole elements are arranged in a diamond shape wherein each individual dipole element is orthogonal to two dipole elements closest to said individual dipole element.

2. The antenna of claim 1 wherein said first substantially vertical lines for all said dipole sub-arrays lie along a first overall substantially vertical line and said second substantially vertical lines for all said dipole sub-arrays lie along a second overall substantially vertical line such that said phase centers for all first and second dipole elements in said antenna line up vertically along said first overall substantially vertical line and said phase centers for all third and fourth dipole elements in said antenna line up vertically along said second overall substantially vertical line.

3. The antenna of claim 1 wherein all said first and third dipole elements in said antenna combine to form a first dipole element array and all said second and forth dipole elements in said antenna combine to form a second dipole element array.

4. The antenna of claim 3 wherein said first dipole element array is fed with a first set of feed lines and said second dipole element array is fed with a second set of feed lines.

5. The antenna of claim 3 wherein all said first and third dipole elements are fed in phase.

6. The antenna of claim 3 wherein all said first and third dipole elements are fed in parallel.

7. The antenna of claim 3 wherein all said second and fourth dipole elements are fed in phase.

8. The antenna of claim 3 wherein all said second and fourth dipole elements are fed in parallel.

9. The antenna of claim 1 further comprising a back plate, wherein said first, second, third, and fourth dipole elements are secured to said back plate.

10. The antenna of claim 1 further comprising isolation plates between each said dipole sub-array for enhancing the isolation between said dipole elements of said antenna.

11. The antenna of claim 1 wherein the horizontal beamwidth of said antenna is approximately 60 degrees.

12. A 45 degree polarization diversity antenna comprising:

an elongated back plate;

a plurality of dipole sub-arrays, each dipole sub-array including:

first, second, third, and fourth elongated dipole elements secured to said back plate, said first and third dipole elements being tilted at an angle of about 45 degrees to the right of vertical and said second and fourth dipole elements being tilted at an angle of about 45 degrees to the left of vertical;

each said dipole element having a phase center, and wherein the phase centers of the first and second dipole elements are positioned along a first substantially vertical line and the phase centers of the third and fourth dipole elements are positioned along a second substantially vertical line and the phase centers of the first and fourth dipole elements are positioned along a first substantially horizontal line and the phase centers of the second and third dipole elements are positioned along a second substantially horizontal line such that said first, second, third, and fourth dipole elements are arranged in a diamond shape wherein each individual dipole element is orthogonal to two dipole elements closest to said individual dipole element.

13. The antenna of claim 12 wherein said first substantially vertical lines for all said dipole sub-arrays lie along a first overall substantially vertical line and said second substantially vertical lines for all said dipole sub-arrays lie along a second overall substantially vertical line such that said phase centers for all first and second dipole elements in said antenna line up vertically along said first overall substantially vertical line and said phase centers for all third and fourth dipole elements in said antenna line up vertically along said second overall substantially vertical line.

14. The antenna of claim 12 wherein all said first and third dipole elements in said antenna combine to form a first dipole element array and all said second and forth dipole elements in said antenna combine to form a second dipole element array.

15. The antenna of claim 12 wherein none of said first, second, third, or fourth dipole elements intersect with any other first, second, third, or fourth dipole element.

16. The antenna of claim 13 wherein said first overall substantially vertical line is separated from said second overall substantially vertical line.

17. The antenna of claim 14 wherein said first dipole element array is fed with a first set of feed lines and said second dipole element array is fed with a second set of feed lines.

18. The antenna of claim 17 wherein said first and third dipole elements are fed in phase.

19. The antenna of claim 17 wherein said first and third dipole elements are fed in parallel.

20. The antenna of claim 17 wherein said second and fourth dipole elements are fed in phase.

21. The antenna of claim 17 wherein said second and fourth dipole elements are fed in parallel.

22. The antenna of claim 12 further comprising isolation panels between each said dipole sub-array for enhancing the isolation between said dipole elements of said antenna.

23. The antenna of claim 12 wherein the horizontal beamwidth of said antenna is approximately 60 degrees.

24. The antenna of claim 12 further comprising a radome secured to said back plate for protecting said first, second, third, and fourth dipole elements and said back plate.

* * * * *